United States Patent [19]

Davis

[11] 3,930,637

[45] Jan. 6, 1976

[54] FENCE AND FENCE POST ASSEMBLY

[75] Inventor: Delbert A. Davis, Kernersville, N.C.

[73] Assignee: Burlington Industries, Inc., Greensboro, N.C.

[22] Filed: Apr. 12, 1974

[21] Appl. No.: 460,522

[52] U.S. Cl. ..... 256/32; 52/418

[51] Int. Cl.[2] ..... B21F 27/00

[58] Field of Search ..... 256/45, 24; 52/418; 160/400, 402, 399

[56] References Cited

UNITED STATES PATENTS

| | | | |
|---|---|---|---|
| 2,064,165 | 12/1936 | Johnson | 160/400 |
| 3,464,479 | 9/1969 | Bakor | 160/402 |
| 3,537,688 | 11/1970 | Stein | 256/24 |

*Primary Examiner*—Dennis L. Taylor
*Assistant Examiner*—Doris L. Troutman
*Attorney, Agent, or Firm*—Cushman, Darby & Cushman

[57] ABSTRACT

A fence and a fence post assembly for particular application in athletic fields is disclosed. Double-edged pressure sensitive tape is applied to a section of a fence post. The tape facilitates proper alignment of fencing on the post while securely attaching it to the post to prevent relative movement between the fencing and the post. An elongated holding member having an inside surface corresponding generally to the outside surface of the post holds the fencing against the tape. Bolts, or other suitable securing means, join the post and the holding member together thereby holding the fencing material against the tape and the post. The fencing material is preferably a fabric material, while the post is relatively flexible.

22 Claims, 3 Drawing Figures

FENCE AND FENCE POST ASSEMBLY

SUMMARY OF THE INVENTION

It has long been a problem in providing fencing for athletic fields to provide a fence that, while sturdy, has sufficient give to prevent injury to a person colliding with the fence.

It has also long been a problem in constructing fences of a fabric material, to provide a suitable means for holding the fabric to fence posts while reducing wearing or fraying of the fencing fabric. It has also long been a problem to properly align fabric fencing material with the posts for secure attachment thereto.

Typical prior art devices having one or more of the above-mentioned problems are disclosed in U.S. Pat. Nos. 2,872,161, 2,997,277, 3,537,688 and 3,332,667.

The fence and the fence post of the present invention provide a fence that is easily assembled and sturdy, while having sufficient flexibility so that should an individual forcibly contact the fence injury to the individual will be prevented, and the fence will return to its original condition after impact without tearing or fraying of the fencing material. Generally, the fence is constructed from sheet material. The sheet material is connected to fence posts by a section of double-faced pressure sensitive tape affixed to the post. The tape allows easy and proper alignment of the sheet fence material with the post, and considerably facilitates the attachment of final securing means. The fencing is held against the tape and the post after final assembly by an elongated holding means, the elongated holding member having an inside surface thereof conforming substantially to the outside portion of the post. The elongated holding member is held to the post by suitable securing means, such as nuts and bolts. The provision of the double-faced pressure sensitive tape prevents relative movement between the sheet fencing material and the holding member, thereby reducing wear at the interface between the holding member and the fencing material, and preventing fraying and tearing of the fencing material upon collision of a person with the fence.

It is an object of this invention to provide a fence that is easily constructed, sturdy, and particularly adapted for use around athletic fields.

It is a further object of this invention to provide a fence with sheet fencing material that is positively held against relative movement with respect to the fence post assemblies, thereby preventing wearing, fraying, and/or tearing of said fencing material.

It is a further object of this invention to provide a fence post with double-faced pressure sensitive tape affixed thereto for facilitating assembly of fencing material to said post while allowing flexibility of the fence created thereby.

It is a further object of this invention to provide holding means for holding fencing against a fence post according to the present invention.

These and other objects of the invention will become clear upon an inspection of the ensuing detailed description of the invention.

DETAILED DESCRIPTION OF THE INVENTION

Figure 1:
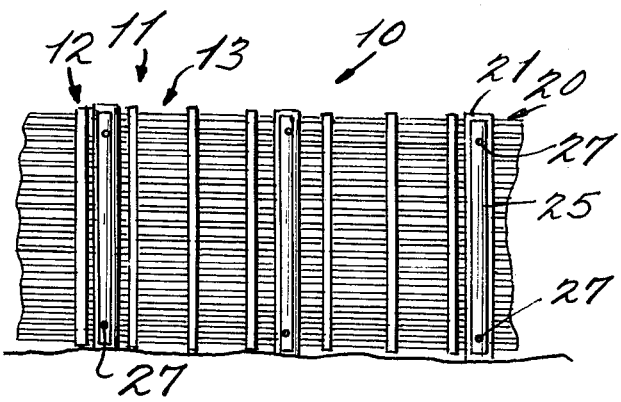
FIG. 1 is an elevational view of an installed section of fence according to the teachings of the present invention.

In FIG. 1, a fence according to the teachings of the present invention is shown generally by reference numeral 10. The fencing material, shown generally at 11, is a flexible sheet or fabric material. The preferred fencing material is that fully disclosed in co-pending application Ser. No. 355,733, filed Apr. 30, 1973, which is a continuation-in-part of application Ser. No. 134,327, filed Apr. 15, 1971, and now abandoned. This preferred material is a length of fabric woven from strands of tough synthetic plastic material, said fabric having laterally spaced longitudinal bands of relatively tightly woven wrap and filling strands, shown generally at 12, separated by relatively open longitudinal bands containing only filling strands, shown generally at 13. The fabric has a relatively thin elastomeric weather resistant coating substantially evenly adhered to the surface of each strand, the relative thickness of said coating being no greater than the diameter of each of the strands. The fencing is formed into a fence by attachment of the fencing material to fence post assemblies, shown generally at 20.

The fence post itself, 21, of fence post assembly 20 is preferably formed of a plastic pipe. Plastic is the preferred material due to its relative inexpensiveness, lightness, ductility, and durability in sunlight, heat, cold, rain and snow. When used as a perimeter fence for sporting events, such as football, soccer, baseball, track, etc., it is desirable that the post be rigid enough to support the fence and maintain an upright position in high winds, but at the same time giving and not breaking during collision of a fast moving athlete with the fence. The post material should also not be shatterable so as to form jagged, spear-like points on which a person could be injured when the force is sufficient enough to break the fence post. A suitable material for this purpose is polyvinyl chloride although polystyrene, polypropylene, and polyethylene could also be used. Other materials are also suitable for the post, however; for instance a metal post having a u-shaped cross-section, or a wooden post having a circular cross-section are also suitable except if the fence is to be used as a perimeter fence for athletic fields.

Figure 3:
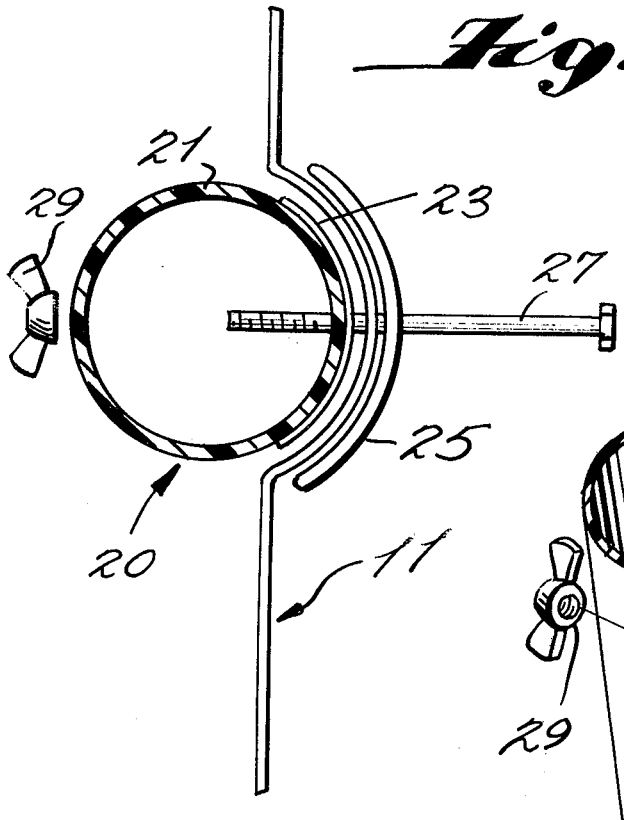
FIG. 3 is a cross-sectional exploded view showing in disassembled array the components of the fence according to the teachings of the present invention.
Figure 2:
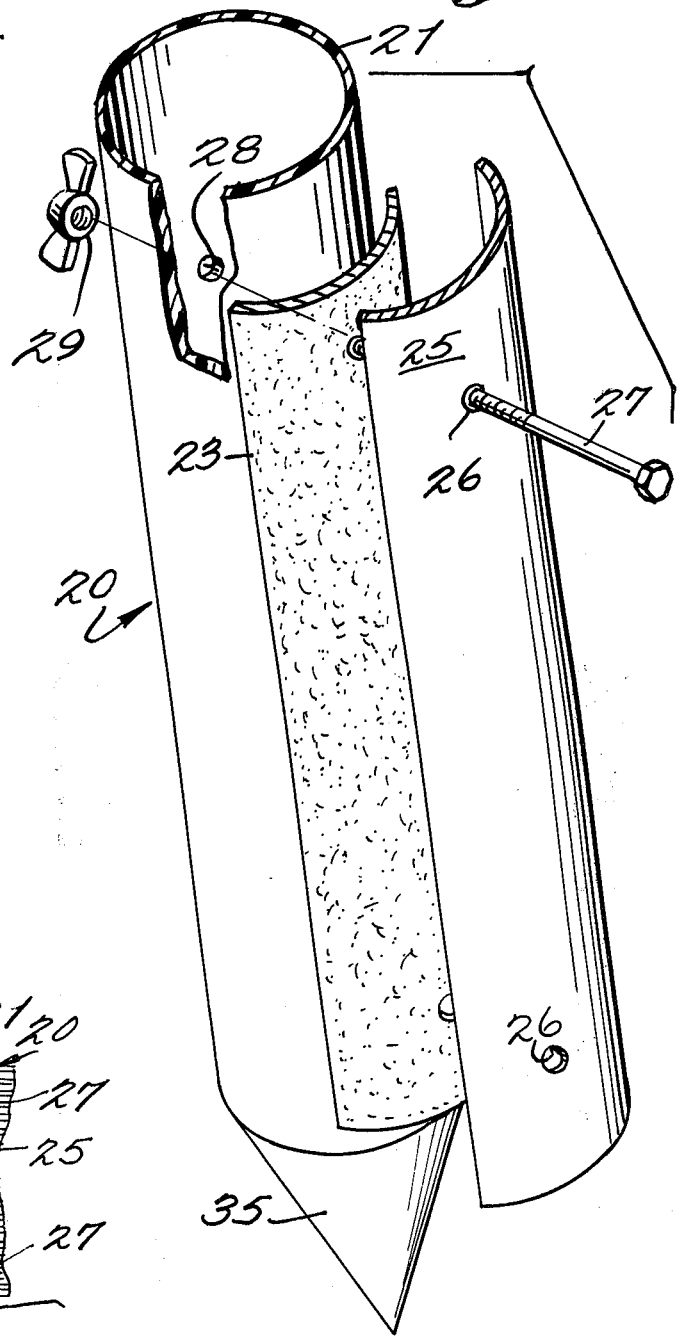
FIG. 2 is an exploded perspective view of a fence post assembly according to the teachings of the present invention.

As clearly shown in FIGS. 2 and 3, the fence post 21 has a section of double-faced pressure sensitive tape, 23, affixed to at least a portion thereof. The double-faced pressure sensitive tape can be that shown in U.S. Pat. No. 3,021,250, or of any other suitable design. One face of the tape may be applied to the post when the post is made, and a fencing sheet attached to the exposed face of the tape, or, the tape can be provided in a roll and applied to the fence post just before assembly of the fence. An elongated holding means, 25, is provided to hold the fencing material 11 against the tape 23. The holding means is preferably a section of pipe of slightly larger diameter than pipe 21. The section is substantially one-third of a pipe, thus covering approximately one-third of the circumference of pipe 21. Tape section 23 also preferably covers about one-third of the circumference of pipe 21, however the tape section need not necessarily extend the whole length of the pipe 21, but may be formed in strips along the length thereof. The holding means may be attached to pipe 21 by bolts 27 extending through holes 26 in member 25 and holes 28 in pipe 21, and secured by wing nuts 29. Holding member 25 may also be of any suitable material such as plastic or wood.

A pointed portion 35 may be formed on pipe 21 for facilitating insertion of the pipe into the ground. Whether or not a pointed section 35 is provided, the pipes may be driven into the ground by means of a capped pipe sleeve larger in diameter than the pipe to be driven, the capped pipe sleeve being the protective element against which a sledge or other heavy object may be pounded to drive the pipe. Alternatively, holes may be bored or dug and the pipe set in place, or a sleeve larger in diameter may be set in a hole allowing the fence post to be inserted in the sleeve for easy installation and removal, allowing the fence to be set in place or taken down quickly. Driven posts may be reinforced, if desired, by pouring sand, dirt, cement or other similar material inside the pipe to a distance of perhaps one-third the length of the pipe.

A fence according to the present invention is assembled as follows: Posts 20 are installed in the ground around the perimeter of the area to be fenced. Double-faced pressure sensitive tape is then affixed to a curved portion of said posts, or, the facing sheet on the tape already affixed to said post is removed. Fencing material 11 is then drawn in place with proper alignment, care being taken to make the fencing as uniformly smooth and taut as possible for neatness and also to assure that there are no wrinkles or areas of unevenness leading to irregular movement leading to excess abrasion and untimely wear. After the fencing is set in place, the holding member 25 is placed over fencing material 11, coextensive with tape section 23. Then holding member 25 is secured to post 21 by insertion of bolts 27 through the holding member and the post, and finally attached thereto by nuts 29.

When assembled in this manner, the tape 23, in addition to facilitating proper alignment and easy assembly of the fence, prevents fencing material 11 from being pulled through between post 21 and holding member 25 upon collision of an individual with the fence, and thereby reduces tearing, wearing, and fraying of the fencing material.

It is obvious that many modifications of the present device are possible. For instance, the fencing could be used for purposes other than as a perimeter fence for an athletic field, such as for snow fencing or the like. In such a case, the parameters for material selection would be different. While a circular cross-section of the fence post is preferable due to maximum bending capability for a given amount of material of this shape and due to the ease of obtaining such posts, other shapes are suitable including flat-sided rectangular-cross-sectioned posts; in some situations it would be preferable to attach the tape to the holding member rather than the post. Also, holding member 25 may be attached to the post by means other than nuts and bolts, such as weather-resistant tie wires or polypropylene strapping.

A fence post assembly and a fence that is easily assembled and suitable as perimeter fencing for an athletic field fulfilling all the objects of the present invention has clearly been disclosed. Although the invention has been herein shown and described in what is conceived to be the most practical and preferred embodiments, it is recognized that departures may be made therefrom within the scope of the invention which is not to be limited to details disclosed but is to be accorded the full scope of the claims so as to embrace any and all equivalent structures and devices.

What I claim is:

1. A fence post assembly comprising a post adapted to be installed in the ground, a section of double-faced pressure sensitive tape for affixing to at least a portion of said post for holding fabric fencing thereto, and holding means for securing fencing to said tape against said post, whereby fencing can be easily aligned with said post and securely attached thereto without wearing at the points of engagement with said holding means.

2. A fence post assembly as recited in claim 1 wherein said post has a curved surface on at least a portion of the outside surface area thereof and wherein said holding means includes an elongated holding member having a curved inside surface of substantially the same curvature as said curved surface of said post.

3. A fence post assembly as recited in claim 2 wherein said holding means further includes a bolt insertable through a hole in said member and said post, and a nut, said nut and bolt securing said member to said post.

4. A fence post assembly as recited in claim 2 wherein said holding means covers substantially one-third the circumference of said post.

5. A fence post assembly as recited in claim 1 wherein said post is composed of plastic.

6. A fence post assembly as recited in claim 5 wherein said plastic is relatively flexible, being rigid enough to withstand winds and support fencing but bending while not breaking upon collision with an object or person.

7. A fence post assembly as recited in claim 1 wherein said post is a pipe of generally circular cross-section.

8. A fence post assembly as recited in claim 1 wherein said tape extends substantially the whole length of said post above the ground.

9. A fence post assembly as recited in claim 8 wherein said tape has a width substantially one-third the circumference of said post.

10. A fence post assembly as recited in claim 1 wherein said holding means includes an elongated holding member having an inside surface conforming substantially to the outside surface of said post.

11. A fence assembly comprising a fence post adapted to be installed in the ground, a section of double-faced pressure sensitive tape affixed to at least a portion of said post, fabric fencing affixed to said post by said tape, and holding means for holding said fabric fencing against said tape.

12. A fence assembly as recited in claim 11 wherein said fabric fencing is woven from strands of tough synthetic plastic material.

13. A fence assembly as recited in claim 12 wherein said fabric has laterally-spaced longitudinal bands of relatively tightly woven wrap and filling strands separated by relatively open longitudinal bands containing only filling strands.

14. A fence assembly as recited in claim 13 wherein said fabric has a relatively thin elastomeric weather-resistant coating substantially evenly adhered to the surface of each strand, the relative thickness of said coating being no greater than the diameter of each of said strands.

15. A fence assembly as recited in claim 11 wherein said post is a plastic pipe of substantially circular cross-section.

16. A fence assembly as recited in claim 15 wherein said holding means includes an elongated holding member having a curved inside surface of substantially the same curvature as said post.

17. A fence assembly as recited in claim 16 wherein said holding member covers substantially one-third the circumference of said post.

18. A fence assembly as recited in claim 17 wherein said tape covers substantially the same circumference of said post as said holding member.

19. A fence assembly as recited in claim 16 wherein said holding means further includes a bolt insertable through a hole in said holding member and said post, and a nut, said nut and bolt securing said holding member to said post.

20. A fence assembly as recited in claim 11 wherein said tape extends substantially the whole length of said post above the ground, and wherein said tape has a width substantially one-third the circumference of said pipe.

21. A fence assembly as recited in claim 11 wherein said holding means includes an elongated holding member having an inside surface conforming substantially to the outside surface of said post.

22. A fence post assembly comprising a post adapted to be installed in the ground, holding means for securing fabric fencing to said post, and a section of double-faced pressure sensitive tape for affixing to at least a portion of said holding means for holding fabric fencing thereto, whereby fencing can be securely attached to said post without wearing at the points of engagement with said post and said holding means.

* * * * *